US007167570B2

(12) United States Patent
Kobayashi

(10) Patent No.: US 7,167,570 B2
(45) Date of Patent: Jan. 23, 2007

(54) PIEZO-ELECTRIC SPEAKER

(76) Inventor: Fujihiko Kobayashi, 19-12, Mitojimamotomachi, Fuji-shi, Shizuoka-ken (JP)

( * ) Notice: Subject to any disclaimer, the term of this patent is extended or adjusted under 35 U.S.C. 154(b) by 422 days.

(21) Appl. No.: 09/940,729

(22) Filed: Aug. 28, 2001

(65) Prior Publication Data

US 2002/0067840 A1 Jun. 6, 2002

(30) Foreign Application Priority Data

Aug. 29, 2000 (JP) ..... 2000-259589
Jun. 22, 2001 (JP) ..... 2001-189983

(51) Int. Cl.
*H04R 17/00* (2006.01)

(52) U.S. Cl. ..... 381/190; 381/152

(58) Field of Classification Search ..... 381/111, 381/114, 190, 152, 398, 310; 310/321–322, 310/334, 345

See application file for complete search history.

(56) References Cited

U.S. PATENT DOCUMENTS 3,721,840 A * 3/1973 Yamada ..... 310/334
4,820,952 A * 4/1989 Lee ..... 381/190
5,641,164 A * 6/1997 Doederlein et al. ..... 273/237
5,761,324 A * 6/1998 Kanai et al. ..... 381/190
6,332,029 B1 * 12/2001 Azima et al. ..... 381/152

* cited by examiner

*Primary Examiner*—Daniel Swerdlow
(74) *Attorney, Agent, or Firm*—Harness, Dickey & Pierce, P.L.C.

(57) ABSTRACT

The present invention intends to provide a piezo-electric speaker which can generate a sound from the low frequency range to the high frequency range as well as transmit the acoustic vibration to a sound-board with a high efficiency. This is achieved by providing a piezo-electric speaker comprising a piezo-electric member generating a strain according to an electric signal applied thereto; a piezo-electric vibration plate converting the strain to the acoustic vibration; and a sound-board resonating to the acoustic vibration; the piezo-electric plate being supported on the sound-board; the acoustic vibration caused by the piezo-electric vibration plate being propagated from the sound-board to the ambient air to generate a sound.

6 Claims, 13 Drawing Sheets

( a )

( b )

( a )

( b )

( a )

( b )

PIEZO-ELECTRIC SPEAKER

BACKGROUND OF THE INVENTION

1. Field of the Invention

The present invention relates to a piezo-electric speaker using a piezo-electric member.

2. Description of Background Art

In a conventional piezo-electric speaker, a piezo-electric vibration plate having the piezo-electric member is directly secured to a case and the sound is propagated to the ambient air by the acoustic vibration caused by the piezo-electric vibration plate. In this case, the case is formed by a no-resonant rigid body.

However, in the conventional piezo-electric speaker the size of the piezo-electric vibration plate is limited since it is difficult to make a piezo-electric member of a large area due to the difficulty of assuring the strength of a thin piezo-electric porcelain used for the piezo-electric member. Accordingly, it is difficult to generate the sound of low frequency range at a predetermined volume without using the acoustic vibration of a large area. Although the sound of high frequency range could be generated if the piezo-electric member having a large area would be formed with increasing its thickness, it is also difficult to generate the sound of high frequency range since the high frequency response is detracted due to the increased thickness of the piezo-electric member.

SUMMARY OF THE INVENTION

It is, therefore, an object of the present invention to provide a piezo-electric speaker which can generate a sound from the low frequency range to the high frequency range as well as transmit the acoustic vibration to a sound-board with a high efficiency.

According to the present invention the object above can be achieved by providing a piezo-electric speaker comprising a piezo-electric member generating a strain according to an electric signal applied thereto; a piezo-electric vibration plate converting the strain to the acoustic vibration; and a sound-board resonating to the acoustic vibration; the piezo-electric plate being supported on the sound-board; the acoustic vibration caused by the piezo-electric vibration plate being propagated from the sound-board to the ambient air to generate a sound.

Preferably the piezo-electric speaker further comprises an elastic member supporting the piezo-electric vibration plate on the sound-board for generating a sound from the sound-board transmitted thereto from the piezo-electric vibration plate via the elastic member.

In the piezo-electric speaker, it is preferable that the elastic member is adhered to the whole surface of the piezo-electric vibration plate.

In the piezo-electric speaker, it is also preferable that the elastic member supports the piezo-electric vibration plate at the periphery thereof.

Preferably the piezo-electric speaker further comprises a vibration transmitting member having a vibration propagating velocity higher than that of the sound-board for supporting the periphery of the piezo-electric vibration plate; the vibration transmitting member being mounted in an aperture formed in the sound-board.

Preferably the piezo-electric speaker further comprises a vibration transmitting member having a vibration propagating velocity higher than that of the sound-board for supporting the periphery of the elastic member; the vibration transmitting member being mounted in an aperture formed in the sound-board.

In the piezo-electric speaker, it is preferable that the vibration transmitting member is a circle-annular vibration ring.

In the piezo-electric speaker, it is preferable that the vibration transmitting member is a plate-shaped vibration board.

BRIEF DESCRIPTION OF THE DRAWINGS

Preferred embodiments of the present invention will be described with reference to the accompanied drawings in which.

DESCRIPTION OF THE PREFERRED EMBODIMENTS

Figure 1:
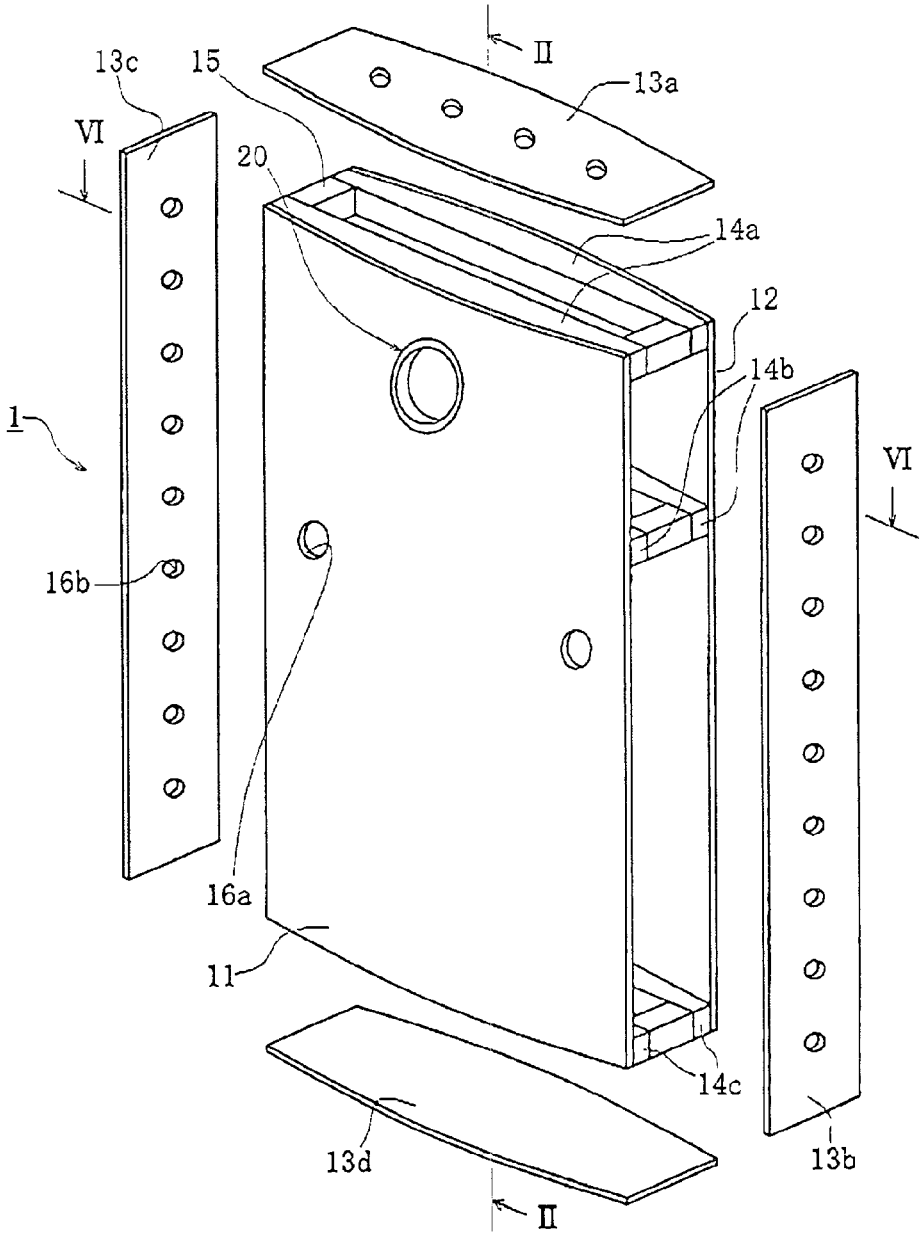
FIG. 1 is a perspective exploded view of one preferred embodiment of the present invention.
Figure 2:
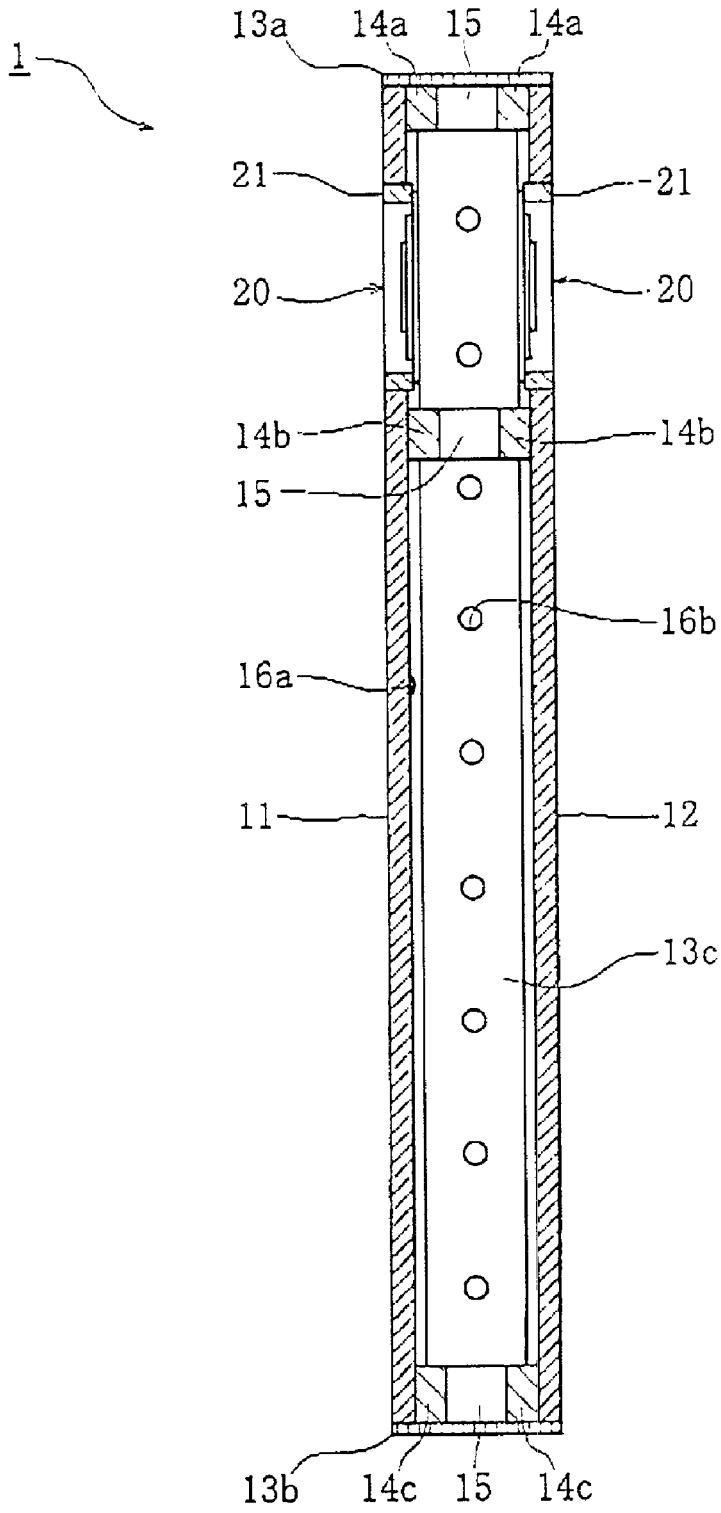
FIG. 2 is a cross-sectional view taken along a line II—II in FIG. 1.
Figure 3:
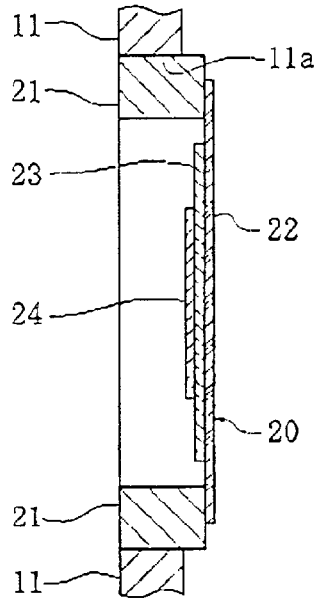
FIG. 3 is a partially enlarged cross-sectional view of a vibration transmitting case shown in FIG. 2.
Figure 4:
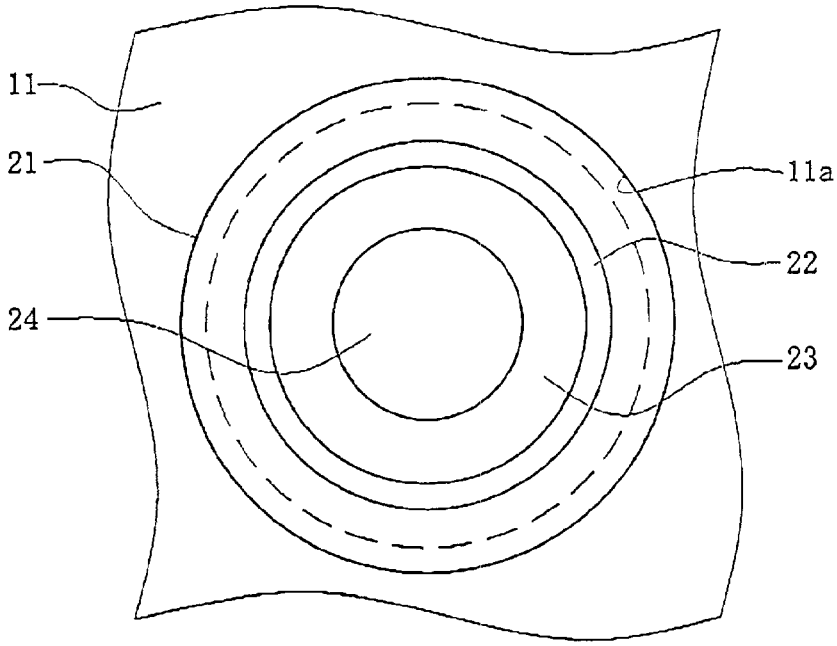
FIG. 4 is a front elevation view of the vibration transmitting case of FIG. 3.
Figure 5:
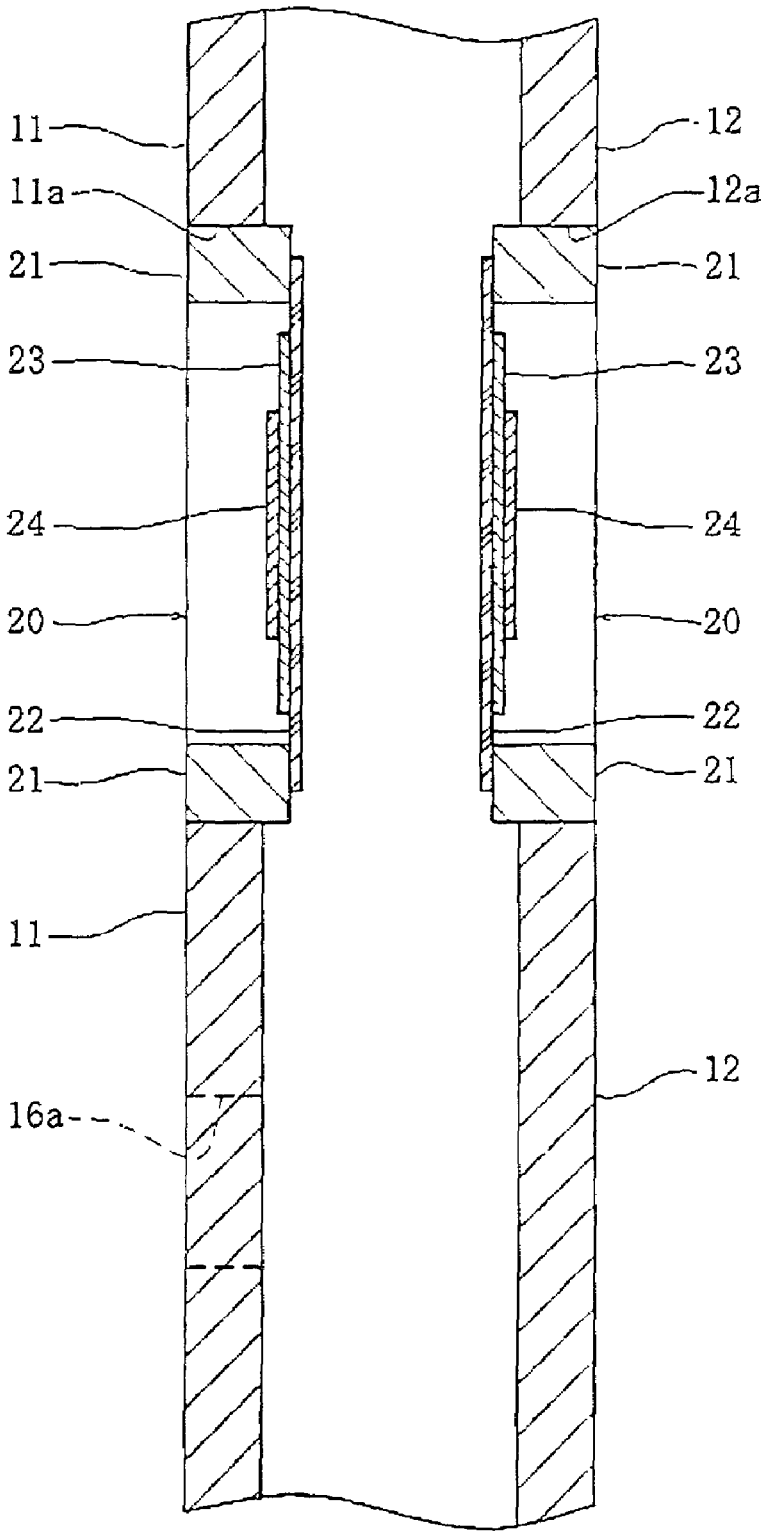
FIG. 5 is a partially enlarged cross-sectional view of FIG. 2.
Figure 6:
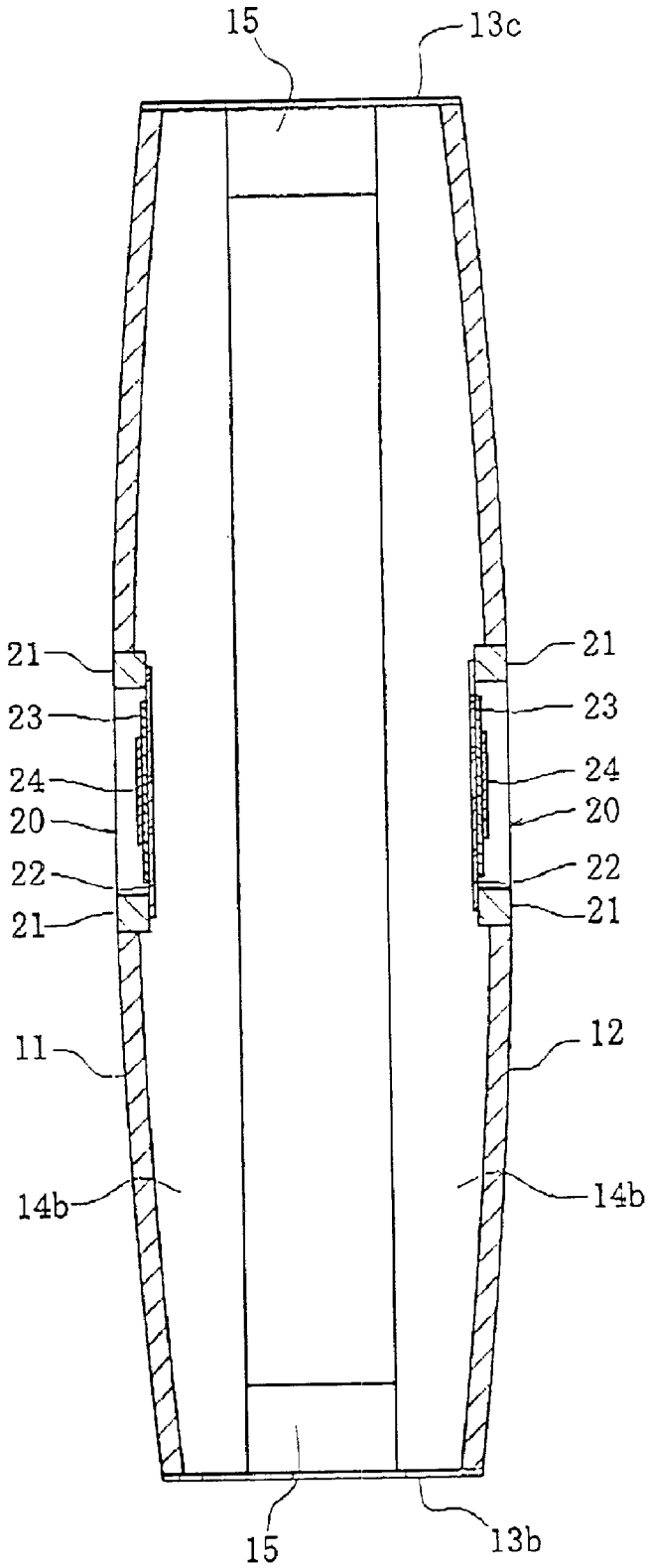
FIG. 6 is a cross-sectional view taken along a line VI—VI in FIG. 1.

As shown in FIGS. 1 through 6, the present invention is embodied as a speaker to be connected to a sound regenerating apparatus such as a CD player or MD player used in a living room at a home, but not limited only thereto. The piezo-electric speaker 1 consists mainly of a vibration transmitting case 20 and of sound-boards 11 and 12.

The vibration transmitting case 20 as a sound generating member comprises a piezo-electric member 24, piezo-electric vibration plate 23, an elastic member 22, and a vibration ring 21. The piezo-electric member 24 is formed of a disk-shaped piezo-electric porcelain generating a mechanical strain when applied an electric signal. The piezo-electric vibration plate 23 is formed of a metal disk and has an area larger than that of the piezo-electric member 24. The piezo-electric member 24 is adhered to one side of the piezo-electric vibration plate 23 to form a unimorph structure. The piezo-electric vibration plate 23 intends to convert the mechanical strain to the acoustic vibration. It is not limited to the unimorph structure and thus the piezo-electric member 24 may be adhered to either sides of the piezo-electric vibration plate 23 to form a bimoiph structure. The piezo-electric member 24 is not limited to the piezo-electric porcelain and may be formed by any material having the piezo effect such as piezo-polymer films or piezo-composite materials. The configuration of the piezo-electric member 24 is also not limited to a disk and any configuration such as a square or a rectangle may be adopted.

The thin plate-shaped elastic member 22 having an area larger than that of the piezo-electric vibration plate 23 is adhered to the side thereof opposite to the piezo-electric member 24. The larger area of the piezo-electric vibration plate 23 near to that of the elastic member 22, the larger amplitude of vibration of the elastic member 22 can be obtained. The material suitable for the elastic member 22 is one having a large modulus of elasticity and a light weight in order to efficiently transmit the acoustic vibration to the vibration ring 21 and includes, for example, elastic rubber, polyvinyl chloride, cellulose fiber sheet, polyacetal fiber sheet, carbon fiber sheet, Kevler (T. M.) fiber sheet, elastic polyethylene, elastic polyester, etc.

The outer periphery of the elastic member 22 is adhered to the end surface of the circle-annular vibration ring 21. The vibration ring 21 is a vibration transmitting member made of wood similar to the sound-boards 11 and 12 but having the vibration transmitting velocity higher than that of the sound-boards 11 and 12. The configuration of the vibration ring 21 is not necessary a perfect circle-annular and may be any other configuration such as an elliptic-annular or a polygonal-annular configuration.

The sound-boards 11 and 12 are vibration members intended to propagate the acoustic vibration to the ambient air resonating to the acoustic vibration of the piezo-electric vibration plate 23. The sound-boards 11 and 12 are made of wood plates. Suitable member for the sound-boards is one having characteristics such as elasticity, light weight, high vibration transmitting velocity, and low internal loss. Spruce is usually used for the sound-boards. Other wood materials may be used such as Yezo spruce, Sitka spruce, German spruce, fir wood, and Swiss pine in pine woods as well as araucaria, red cedar, and cypress in Japanese cedar woods. The material of the sound-boards is not limited to woods and it is possible to use any material which can be used for the vibration member (resonant member) such as carbon fiber, carbon graphite, glass, ceramics, etc. and composite of these materials.

Sound-bars 14*a*, 14*b* and 14*c* each formed by rectangular bar are laterally adhered to the rear surface of the sound-boards 11 and 12 respectively at uppermost, middle and lowermost positions thereof. Each adhering surface of the sound-bars 14*a*, 14*b* and 14*c* to the sound-board is formed with an arch and thus the sound-boards 11 and 12 are curved in a convex configuration to form a crown when they are adhered to the sound-bars 14*a*, 14*b* and 14*c*. The grain of the sound-boards 11 and 12 extends vertically and crosses the grain of the sound-bars 14*a*, 14*b* and 14*c* extending horizontally. Although the vibration transmitting velocity of the acoustic vibration of the spruce member in the direction across the grain is ⅓ times the velocity in the direction of the grain, the vibration transmitting velocity of the sound-board 11 and 12 is equalized therein since the sound-bars 14*a*, 14*b* and 14*c* extend in the direction across the grain of the sound-boards 11 and 12. The number of the sound-bars 14*a*, 14*b* and 14*c* is determined according to the area, configuration etc. of the sound-boards 11 and 12. The sound-boards 11 and 12 may be preformed as curved boards. In such a case, the sound-bars 14*a*, 14*b* and 14*c* do not play a part of creating the crown in the sound-boards 11 and 12.

The sound-boards 11 and 12 are adhered each other via connecting bars 15 arranged at opposite ends of each the sound-bars 14*a*, 14*b* and 14*c*. A sound-barrel is formed by adhering a top plate 13*a*, side plates 13*b* and 13*c*, and a bottom plate 13*d* to the united sound-boards 11 and 12. Formed in the sound-board 11 are apertures 16*a* through which the resonated sound generated within the sound-barrel is emitted forward. Similarly in the top plate 13*a* and the side plates 13*b* and 13*c*, formed with are apertures 16*b* through which the resonated sound generated within the sound-barrel is emitted left and right as well as upward. The number of the aperture 16*b* can be freely adjusted by closing the aperture 16*b* with using any plugs (not shown). The aperture 16*b* may be omitted.

The vibration transmitting case 20 is fitted in apertures 11*a* and 12*a* formed in the sound-boards 11 and 12 such that the outer periphery of the vibration ring 21 closely contacts to the inner wall of the apertures 11*a* and 12*a*. The number of the vibration transmitting case 20 to be fitted in the sound-boards 11 and 12 is appropriately determined according to the size and configuration of the sound-boards 11 and 12, and the required sound pressure. The vibration transmitting case 20 may be arranged on only one of the sound-boards 11 and 12. In addition, it is possible to carry out the present invention using only one of the sound boards 11 and 12 without forming the sound-barrel.

The operation of the piezo-electric speaker of the present invention will be hereinafter described. Firstly, an electric signal representative of an acoustic signal is inputted to the piezo-electric member 24. A strain generated in the piezo-electric member 24 by the electric signal causes the vibration of the piezo-electric vibration plate 23. The vibration of the piezo-electric vibration plate 23 is an acoustic vibration corresponding to the acoustic signal inputted to the piezo-electric member 24. The acoustic vibration of the piezo-electric vibration plate 23 is transmitted to the vibration ring 21 via the elastic member 21 and further transmitted to the sound-boards 11 and 12 via the vibration ring 21. The sound-boards 11 and 12 vibrates with a large amplitude resonating to the acoustic vibration imparted thereto. Accordingly, sufficiently large acoustic vibration of the sound-boards 11 and 12 as compared with the amplitude of the piezo-electric vibration plate 23 is propagated to the ambient air from the sound-boards 11 and 12.

According to the piezo-electric speaker 1 of the present invention, the acoustic-vibration generated by the piezo-electric vibration plate 23 is propagated to the ambient air with being resonated by the sound-board 11 and 12 via the elastic member 22. Accordingly, the sound pressure of low frequency range can be ensured although using the piezo-electric vibration plate having a small area. Furthermore, since the thin piezo-electric member 23 improves the loss of the high-frequency response, it is possible to generate a high quality of sound of a wide range from the low frequency range to the high frequency range.

In addition, it is possible to efficiently transmit the acoustic vibration of the piezo-electric vibration plate 23 to the sound-boards 11 and 12 and to generate the sound in the ambient air since the elastic member 22 is adhered to the whole surface of the piezo-electric vibration plate 23 to support it.

In addition, the vibration rings 21 each supporting the outer periphery of the elastic member 25 and having the vibration transmitting velocity higher than that of the sound-boards 11 and 12 are fitted in the apertures 11*a* and 12*a* formed in the sound-boards 11 and 12. That is, since piezo-electric vibration plate 23 is connected to the sound-boards 11 and 12 via the elastic member 22 and the vibration ring 21, the acoustic vibration generated by piezo-electric vibration plate 23 is transmitted to the sound-boards 11 and 12 in a stepped manner. Accordingly, it is possible to efficiently transmit the acoustic vibration to the sound-boards 11 and 12 with reducing drastic change of the mechanical impedance as well as suppressing the transmission loss. Of course, it is necessary for this purpose to set the relation between vibration transmitting velocities of members as followings: piezo-electric vibration plate 23>elastic member 22>vibration ring 21>sound-boards 11 and 12.

Figure 7:
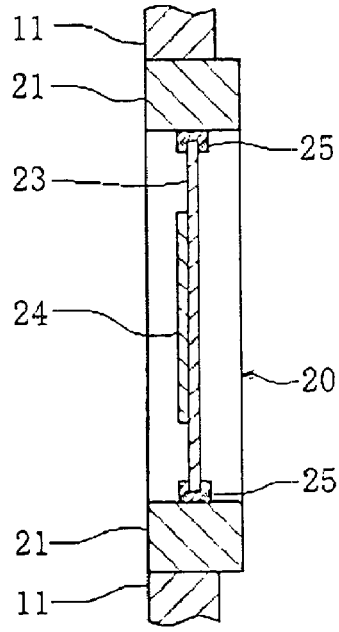
FIG. 7 is a cross-sectional view similar to FIG. 3 showing another embodiment of the vibration transmitting case.

The plate-shaped elastic member 22 may be replaced by a ring-shaped elastic member 25 as shown in FIG. 7, so as to support the outer periphery of the piezo-electric vibration plate 23. In this case, the thickness of the piezo-electric vibration plate 23 is kept thin and thus it is possible to improve the loss of the high-frequency response and to ensure the sound pressure in the high frequency range.

Figure 8:
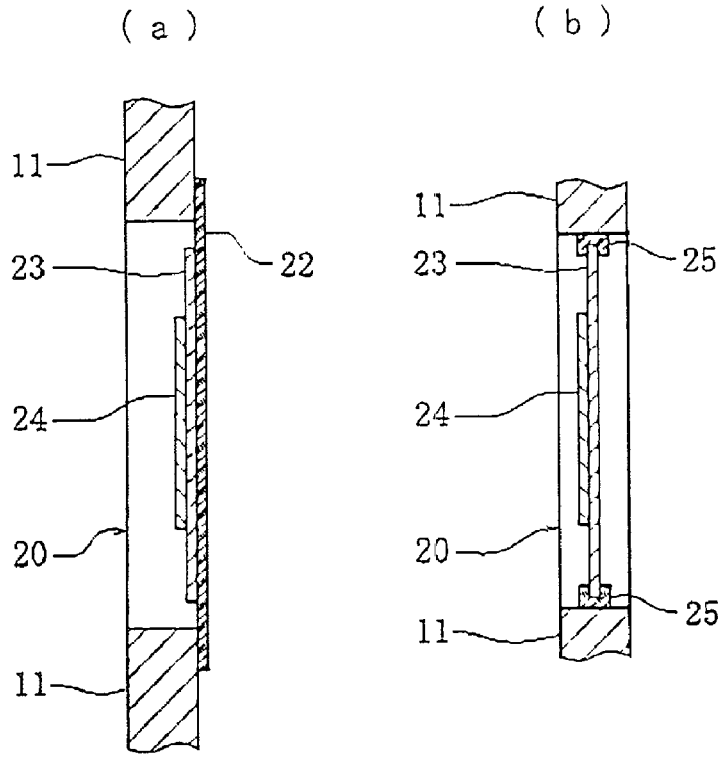
FIG. 8 is a cross-sectional view similar to FIG. 3 showing a further embodiment of the vibration transmitting case.

The elastic members 22 and 25 may be directly secured on the sound-boards 11 and 12 without using the vibration ring 21 as shown in FIG. 8.

Figure 9:
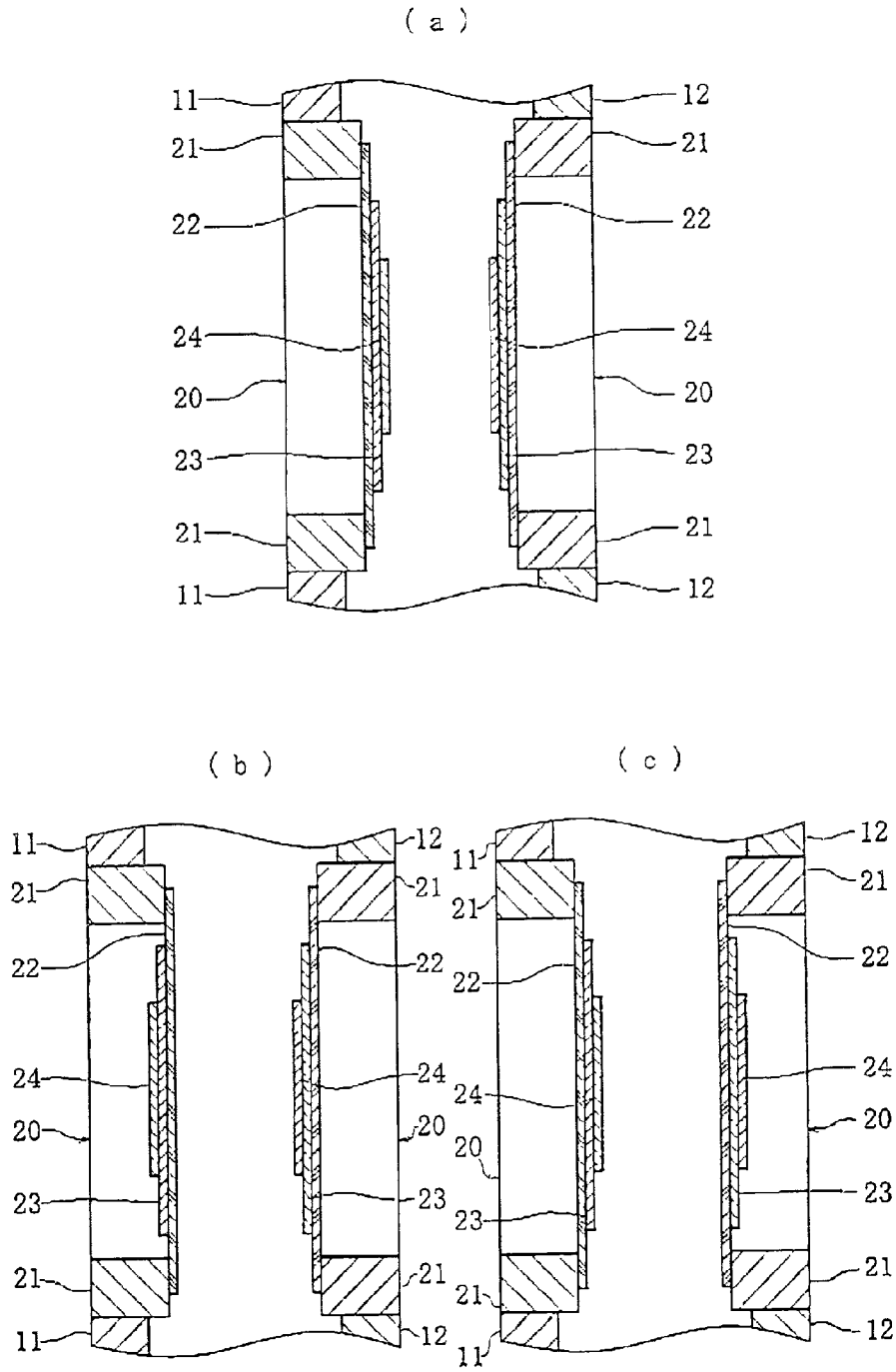
FIG. 9 is a cross-sectional view similar to FIG. 5 showing other mounting arrangements of the vibration transmitting case.

The piezo-electric members 24 can be mounted on the sound-boards 11 and 12 in different ways. For example, it is possible to arrange the two piezo-electric members 24 so that they turn their faces toward opposite directions (FIG. 5), so that they turn their faces toward each other (FIG. 9(*a*)), or so that they turn their faces in the same direction (FIGS. 9(*b*) and (*c*)). In these arrangements, the relation between the sound pressures and between the phases of the acoustic vibration are differentiated. Any suitable combination of the arrangement of the piezo electric members 24 may be selected in accordance with the nature of the required sound.

Figure 10:
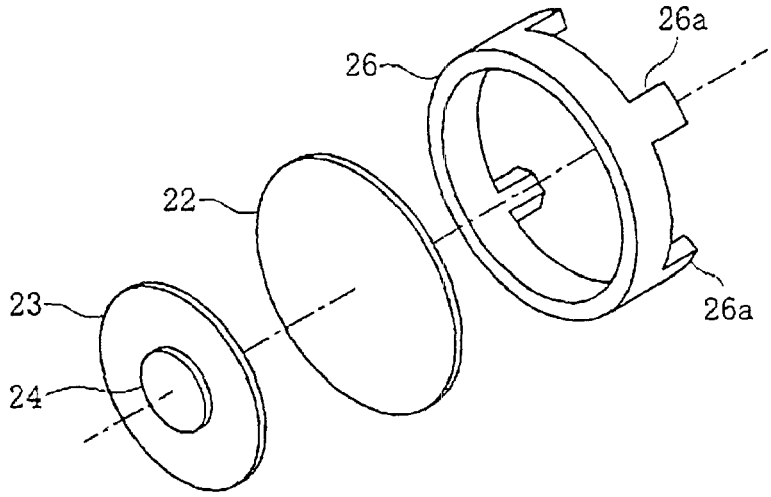
FIG. 10 shows another embodiment of a vibration ring wherein FIG. 10(*a*) is an exploded view thereof and FIG. 10(*b*) is a cross-sectional view similar to FIG. 3.
Figure 10:
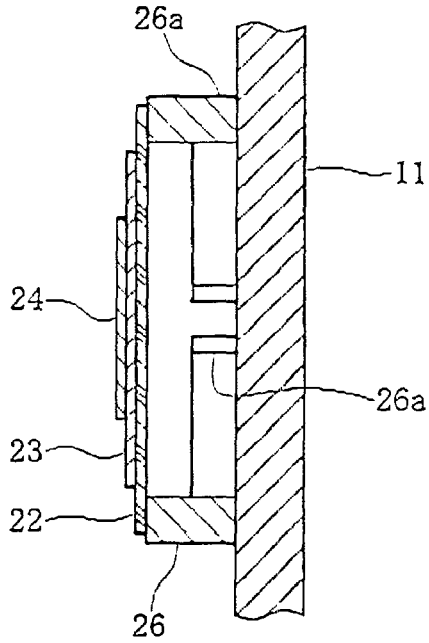

The vibration ring 21 and the vibration transmitting case 20 may be constructed as shown in FIG. 10. That is, the vibration ring 26 in FIG. 10 is a cylindrical body having a plurality of legs 26*a* projected from one end of the body. The elastic member 22 on which the piezo-electric vibration plate 23 supporting the piezo-electric member 24 is adhered is secured on the other end of the cylindrical body. The vibration ring 26 is secured on the sound-boards 11 and 12 via the legs 26*a* as shown in FIG. 10(*b*). The acoustic vibration of the piezo-electric vibration plate 23 is transmitted to the vibration ring 26 via the elastic member 22 and thus the acoustic vibration of the piezo-electric vibration plate 23 is propagated to the ambient air by the sound-boards 11 and 12. Such a structure of the vibration ring 26 enables the formation of the aperture 11*a* and 12*a* to be omitted. It is also possible to directly adhere the cylindrical body to the sound-boards 11 and 12 without using the legs 26*a*.

Figure 11:
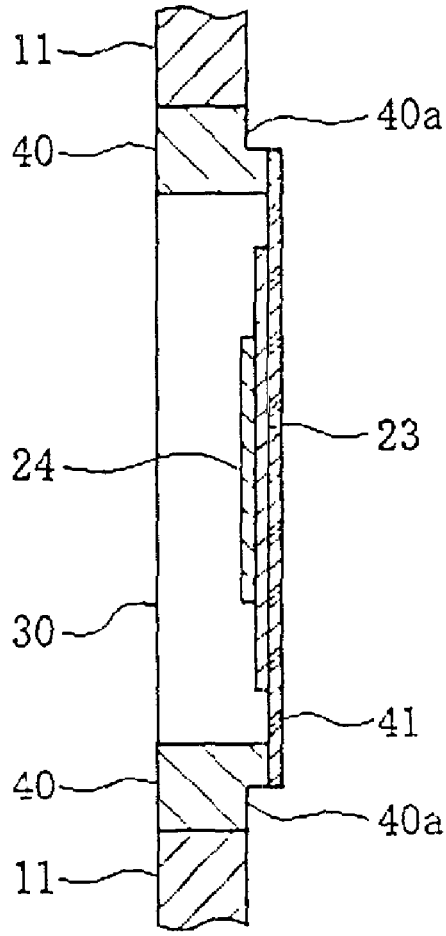
FIG. 11 is a cross-sectional view similar to FIG. 3 showing a further embodiment of the vibration ring.

The energy of the acoustic vibration transmitted to the sound-boards 11 and 12 via the vibration ring can be adjusted by modifying the thickness of the vibration ring, for example, by providing a vibration ring 40 shown in FIG. 11 in which a notch 40*a* is formed around the periphery thereof.

Figure 12:
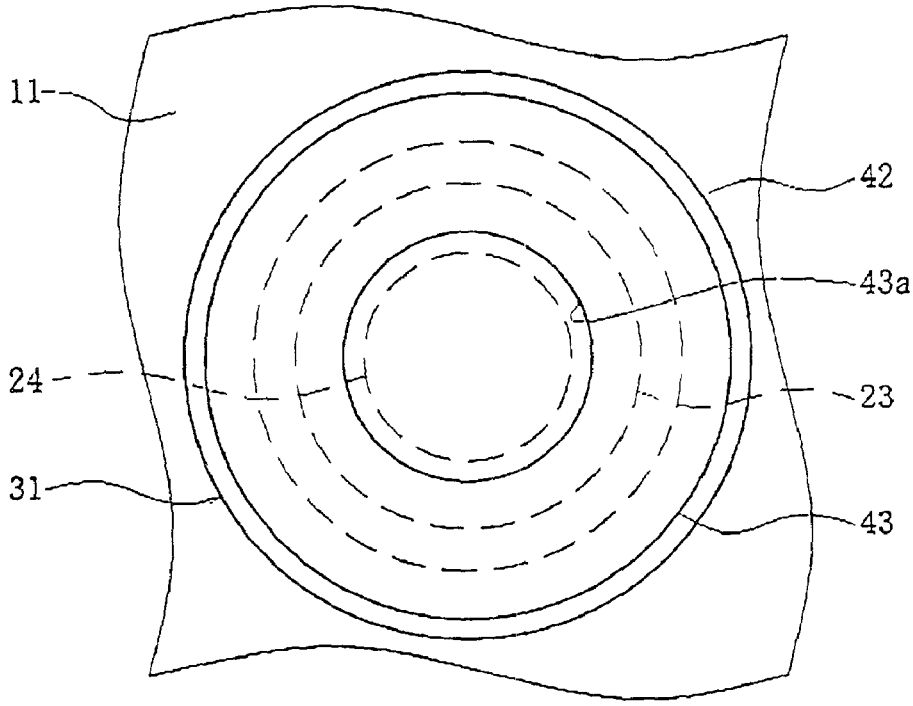
FIG. 12 shows another embodiment of a piezo-electric speaker using an elastic member having an another configuration wherein FIG. 10(*a*) is a rear view thereof and FIG. 10(*b*) is a cross-sectional view similar to FIG. 3.
Figure 12:
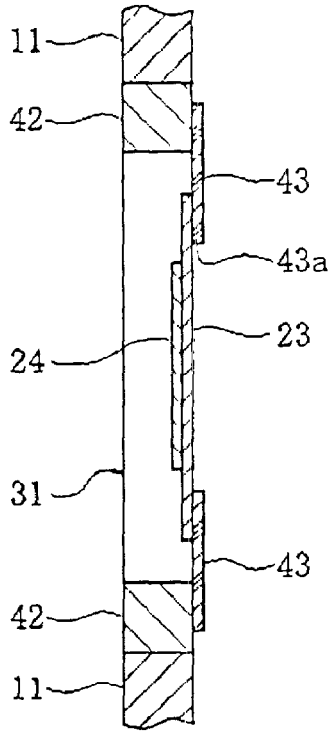

The energy of the acoustic vibration transmitted to the sound-boards 11 and 12 can be also adjusted by modifying the elastic member, for example, by providing an elastic member 43 shown in FIG. 12 in which a central aperture 43*a* is formed. Thus the piezo-electric vibration plate 23 is adhered, only at the outer periphery thereof to the elastic member 43 so as to reduce the acoustic vibration energy transmitted to the sound-boards. By adjusting the acoustic vibration energy, it is possible to prevent the distortion of the sound owing to the over-vibration of the sound-boards.

Figure 13:
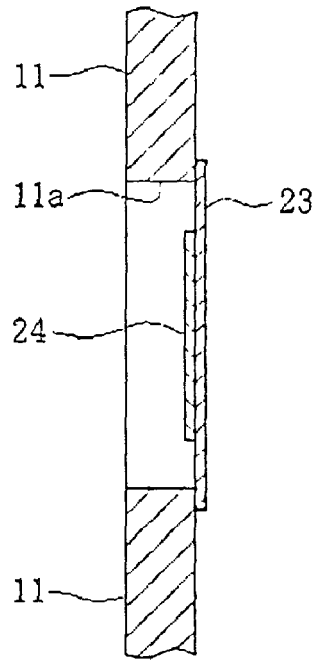
FIG. 13 is a cross-sectional view similar to FIG. 3 showing a further embodiment of a piezo-electric speaker wherein the piezo-electric vibration plate is directly mounted on the sound-board.
Figure 14:
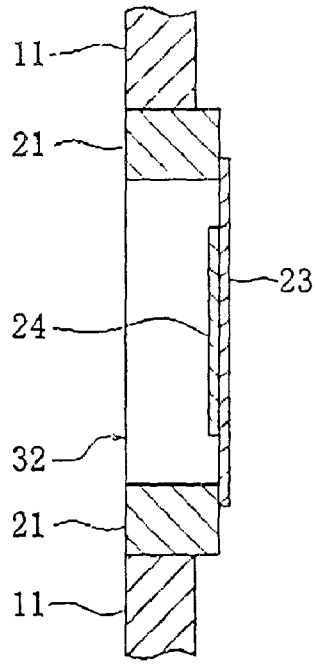
FIG. 14 is a cross-sectional view similar to FIG. 3 showing a further embodiment of a piezo-electric speaker wherein the piezo-electric vibration plate is directly mounted on the vibration ring.

The piezo-electric vibration plate 23 may be supported by the sound-boards 11 and 12 without using the elastic member 22 or 25, for example, as shown in FIGS. 13 through 17. In the example of FIG. 13, the piezo-electric vibration plate 23 is directly secured on the sound-board 11 so that it closes the aperture 11*a* formed in the sound-board 11. The acoustic vibration generated by the piezo-electric vibration plate 23 is directly transmitted to the sound-board 11 and thus the acoustic vibration amplified by the sound-board 11 is propagated to the ambient air. Accordingly, it is possible to generate a sound at a great sound pressure using the piezo-electric vibration plate 23 having a small area. In the example of FIG. 14, the piezo-electric vibration plate 23 is directly secured on the vibration ring 21 forming the vibration transmitting member.

Figure 15:
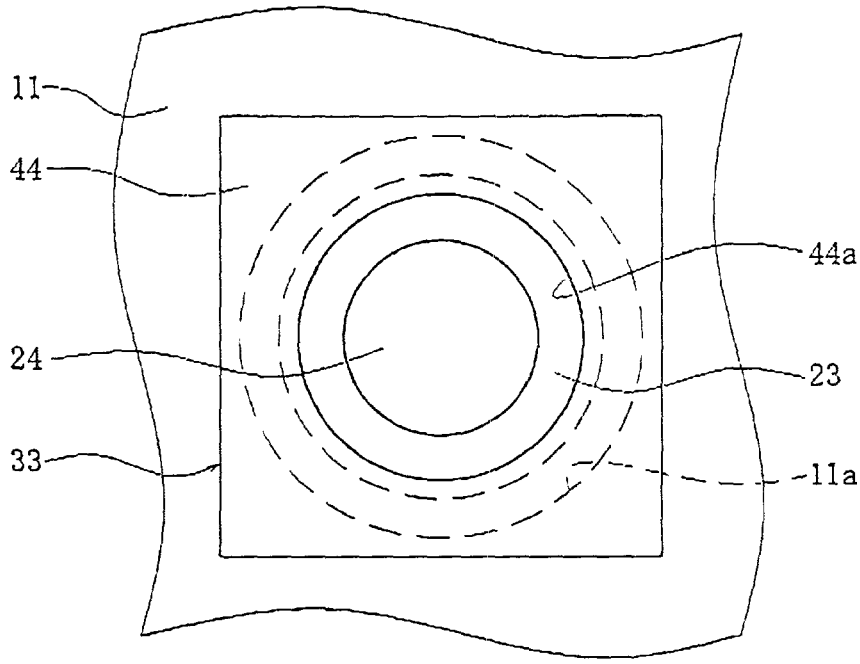
FIG. 15 shows a further embodiment of a piezo-electric speaker using the vibration board wherein FIG. 15(*a*) is a front view thereof and FIG. 15(*b*) is a cross-sectional view similar to FIG. 3.
Figure 15:
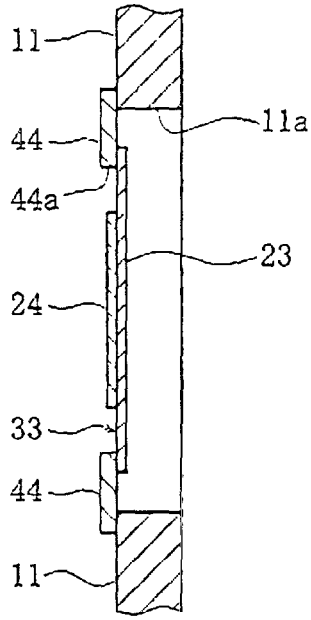

FIG. 15 shows an another embodiment of the piezo-electric speaker of the present invention using a vibration board 44. The vibration board 44 is a square board in which formed at the center thereof is an aperture 44*a* having a diameter slightly smaller than that of the outer diameter of the piezo-electric vibration plate 23. The vibration board 44, similar to the vibration ring 21, is a vibration transmitting member formed by a material having the vibration transmitting velocity higher than that of the sound-boards 11 and 12. For example, the vibration board 44 can be made of spruce, or the wood materials may be used such as Yezo spruce, Sitka spruce, German spruce, fir wood, and Swiss pine in pine woods as well as araucaria, red cedar, and cypress in Japanese cedar woods. The material of the vibration boards is not limited to woods and it is possible to use any material having the vibration transmitting velocity higher than that of the sound-boards 11, for example, carbon fiber, carbon graphite, glass, ceramics, etc. and composite of these materials.

In the piezo-electric speaker shown in FIG. 15, a vibration transmitting case 33 on which the piezo-electric vibration plate 23 is mounted is secured on the sound-board 11 so that it closes the aperture 11*a* of the sound-board 11. The acoustic vibration generated by piezo-electric vibration plate 23 is transmitted to the sound-board 11 in a stepped manner by connecting the piezo-electric vibration plate 23 to the sound-board 11 via the vibration board 44 having the vibration transmitting velocity higher than that of the sound-board 11. Accordingly, it is possible to efficiently transmit the acoustic vibration to the sound-board 11 with reducing drastic change of the mechanical impedance as well as suppressing the transmission loss. Since the vibration board 44 has a plate-shaped configuration and can be easily formed according to the outline of the piezo-electric vibration plate 23, it is possible to easily support the piezo-electric vibration plate 23 without depending on the outline of the piezo-electric vibration plate 23.

Figure 16:
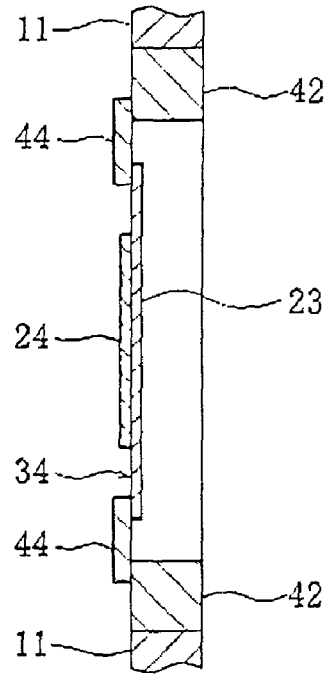
FIG. 16 shows a further embodiment of a piezo-electric speaker using the vibration board and the vibration ring.

In a piezo-electric speaker shown in FIG. 16, the vibration board 44 shown in FIG. 15 is secured on the sound board 11 via the vibration ring 42. Thus the acoustic vibration generated by the piezo-electric vibration plate 23 is transmitted to the sound-board 11 via the vibration board 44 and the vibration ring 42. It is preferable that the relation between vibration transmitting velocities of these members are as followings: vibration board 44>vibration ring 42>sound-board 11.

Figure 17:
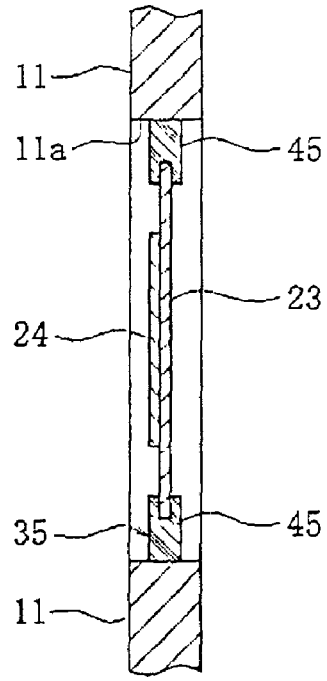
FIG. 17 is a cross-sectional view similar to FIG. 3 showing a further embodiment of a piezo-electric speaker using the vibration board.

In a piezo-electric speaker shown in FIG. 17, a circle-annular vibration board 45 supports the piezo-electric vibration plate 23 at the periphery thereof to form a vibration transmitting case 35 which is fitted in the aperture 11*a* of the sound-board 11. The vibration transmitting case 35 can be formed by molding plastic material such that the vibration board 45 sandwiches the piezo-electric vibration plate 23.

It will of course be understood that various details of construction may be varied through a wide range without departing from the principles of the present invention and it is, therefore, not the purpose to limit the patent granted herein otherwise than necessitated by the scope of the appended claims.

What is claimed is:

1. A piezo-electric speaker comprising a piezo-electric member generating a strain according to an electric signal applied thereto; a piezo-electric vibration plate coupled with and suspending said piezo-electric member and converting the strain to the acoustic vibration; and a sound-board resonating to the acoustic vibration; said piezo-electric member having an area smaller than said piezo-electric vibration plate so that said piezo-electric member is spaced from and out of contact with said sound board; an elastic member supporting the piezo-electric vibration plate on the sound-board for generating a sound from the sound-board transmitted thereto from the piezo-electric vibration plate via the elastic member, said piezo-electric vibration plate supported at its periphery by said elastic member such that said piezo-electric vibration plate is spaced from and out of contact with said sound board, the acoustic vibration caused by the piezo-electric vibration plate being propagated from the sound-board to the ambient air to generate a sound.

2. A piezo-electric speaker of claim 1 wherein the elastic member is adhered to the whole surface of the piezo-electric vibration plate.

3. A piezo-electric speaker of claim 1 further comprising a vibration transmitting member having a vibration propagating velocity higher than that of the sound-board for supporting the periphery of the piezo-electric vibration plate; the vibration transmitting member being mounted in an aperture formed in the sound-board.

4. A piezo-electric speaker of claim 3 wherein the vibration transmitting member is a circle-annular vibration ring.

5. A piezo-electric speaker of claim 3 wherein the vibration transmitting member is a plate-shaped vibration board.

6. A piezo-electric speaker of claim 1 further comprising a vibration transmitting member having a vibration propagating velocity higher than that of the sound-board for supporting the periphery of the elastic member; the vibration transmitting member being mounted in an aperture formed in the sound-board.

* * * * *